US011639834B2

(12) United States Patent
Wiedemann et al.

(10) Patent No.: US 11,639,834 B2
(45) Date of Patent: May 2, 2023

(54) BUTTSTOCK OF A SMALL ARM AND SMALL ARM WITH SUCH A BUTTSTOCK

(71) Applicant: Blaser Group GmbH, Isny (DE)

(72) Inventors: Peter Wiedemann, Scheuring (DE); Paul Seidl, Argenbühl (DE); Martin Vetter, Ulm (DE); Henry Walter, Maierhöfen (DE); Jürgen Rothärmel, Isny (DE); Robin Marx, Isny (DE); Thomas Macher, Oberreute (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 17/549,078

(22) Filed: Dec. 13, 2021

(65) Prior Publication Data

US 2022/0196357 A1 Jun. 23, 2022

(30) Foreign Application Priority Data

Dec. 17, 2020 (DE) ..... 10 2020 133 914.3

(51) Int. Cl.
*F41A 19/10* (2006.01)
*F41C 23/04* (2006.01)

(52) U.S. Cl.
CPC ..... *F41A 19/10* (2013.01); *F41C 23/04* (2013.01)

(58) Field of Classification Search
CPC ..... F41C 23/06; F41C 23/10; F41C 23/04; F41C 23/12
USPC ..... 42/71.01, 72, 71.02, 73
See application file for complete search history.

(56) References Cited

U.S. PATENT DOCUMENTS

| | | | | |
|---|---|---|---|---|
| 201,524 | A * | 3/1878 | Fraser et al. | F41A 19/10 42/74 |
| 1,367,996 | A * | 2/1921 | Sussman | F41A 9/53 42/72 |
| 7,886,473 | B2 | 2/2011 | Rotharmel | |
| 8,656,619 | B2 | 2/2014 | Popikov | |
| 2005/0235546 | A1 * | 10/2005 | Wonisch | F41G 11/003 42/75.01 |
| 2015/0219416 | A1 | 8/2015 | Chvala | |

FOREIGN PATENT DOCUMENTS

| | | | | |
|---|---|---|---|---|
| DE | 102004006364 | A1 | 8/2005 | |
| DE | 102007014899 | A1 | 10/2008 | |
| DE | 102010051641 | B3 | 4/2012 | |
| EP | 3329204 | B1 * | 7/2019 | F41C 23/04 |
| WO | WO-2018128591 | A1 * | 7/2018 | |

OTHER PUBLICATIONS

Result of Examination Report for DE 10 2020 133 914.3, filed Dec. 17, 2020.

* cited by examiner

*Primary Examiner* — Reginald S Tillman, Jr.
(74) *Attorney, Agent, or Firm* — Paul D. Bianco; Fleit Intellectual Property Law

(57) ABSTRACT

A buttstock of a small arm includes a front connection area for a positive connection to a receiver. In order to permit increased cartridge capacity, a trigger unit with a trigger latch and a transfer element extending forward for connection of the trigger latch to a trigger mechanism arranged in the receiver is positioned on the buttstock.

10 Claims, 5 Drawing Sheets

BUTTSTOCK OF A SMALL ARM AND SMALL ARM WITH SUCH A BUTTSTOCK

FIELD OF THE DISCLOSURE

The disclosure concerns a buttstock of a small arm and a small arm with such a buttstock.

BACKGROUND

A buttstock of a repeating rifle with a front connection area for positive connection of the buttstock to a connection housing or receiver of the repeating rifle is known from DE 10 2007 014 899 A1. The receiver of the repeating rifle has a magazine shaft on its bottom to accommodate a magazine provided with a trigger unit. The magazine and trigger unit with the trigger guard and the trigger latch form a simply removable unit that can be stored and transported separately from the repeating rifle, but can also be rapidly mounted again as required. A compact design with high reliability is thereby achieved. However, the cartridge capacity of the magazine is restricted.

SUMMARY

One aspect of the disclosure relates to a buttstock of a small arm and a small arm with such a buttstock that permits increased cartridge capacity. Advantageous embodiments and expedient refinements are disclosed herein.

The buttstock according to the disclosure is characterized by the fact that a trigger unit with a trigger latch and a transfer element extending forward for connection of the trigger latch to a trigger mechanism arranged in the receiver is positioned on the buttstock. By displacement of the trigger unit backward on the buttstock, the magazine can protrude farther downward relative to the receiver so that the cartridge capacity can be increased. The compact design can nevertheless be retained.

In a particularly advantageous embodiment, the buttstock can consist of an extension piece fastenable to the receiver and a buttstock part fastened releasably on the extension piece. The buttstock part, for example, can be made as a shoulder support adjustable relative to the extension piece or as a rifle butt made of wood, plastic or a composite. The trigger unit with the trigger latch and the transfer element can expediently be arranged on the extension piece.

The trigger latch and the transfer element can be arranged in a trigger housing fastened on the buttstock. The transfer element can be expediently designed in the form of a rod or lever. The transfer element is preferably arranged pivotable about an axis and connected to the trigger latch via a linkage so that the front end of the transfer element is raised by pulling the trigger latch. The transfer element can be connected to the trigger mechanism arranged in the receiver via a connection pin movable axially in the trigger housing.

The front connection area of the buttstock is preferably adapted to the shape of a pin on the rear of the receiver and has an internal shape corresponding to the external shape of the pin. A precise and reproducible connection between the buttstock and the receiver can thus be achieved.

The buttstock can be designed in one or more parts. In a multipart design, the buttstock can have an extension piece fastenable on the back of the receiver and a shoulder support adjustable relative to the extension piece. The shoulder support can be guided to move on a guide part arranged on the extension piece.

The trigger unit can expediently be arranged with the trigger latch and the transfer element on the extension piece. A grip designed as a pistol grip, for example, can also be fastened to the extension piece.

The disclosure also concerns a small arm with a buttstock as just described. A trigger mechanism connected to the trigger latch on the buttstock via the transfer element can be arranged in the receiver of the small arm

BRIEF DESCRIPTION OF THE DRAWINGS

Additional details and advantages of the disclosure are apparent from the following description of a preferred embodiment example with reference to the drawings. In the drawing.

DETAILED DESCRIPTION

Figure 1:
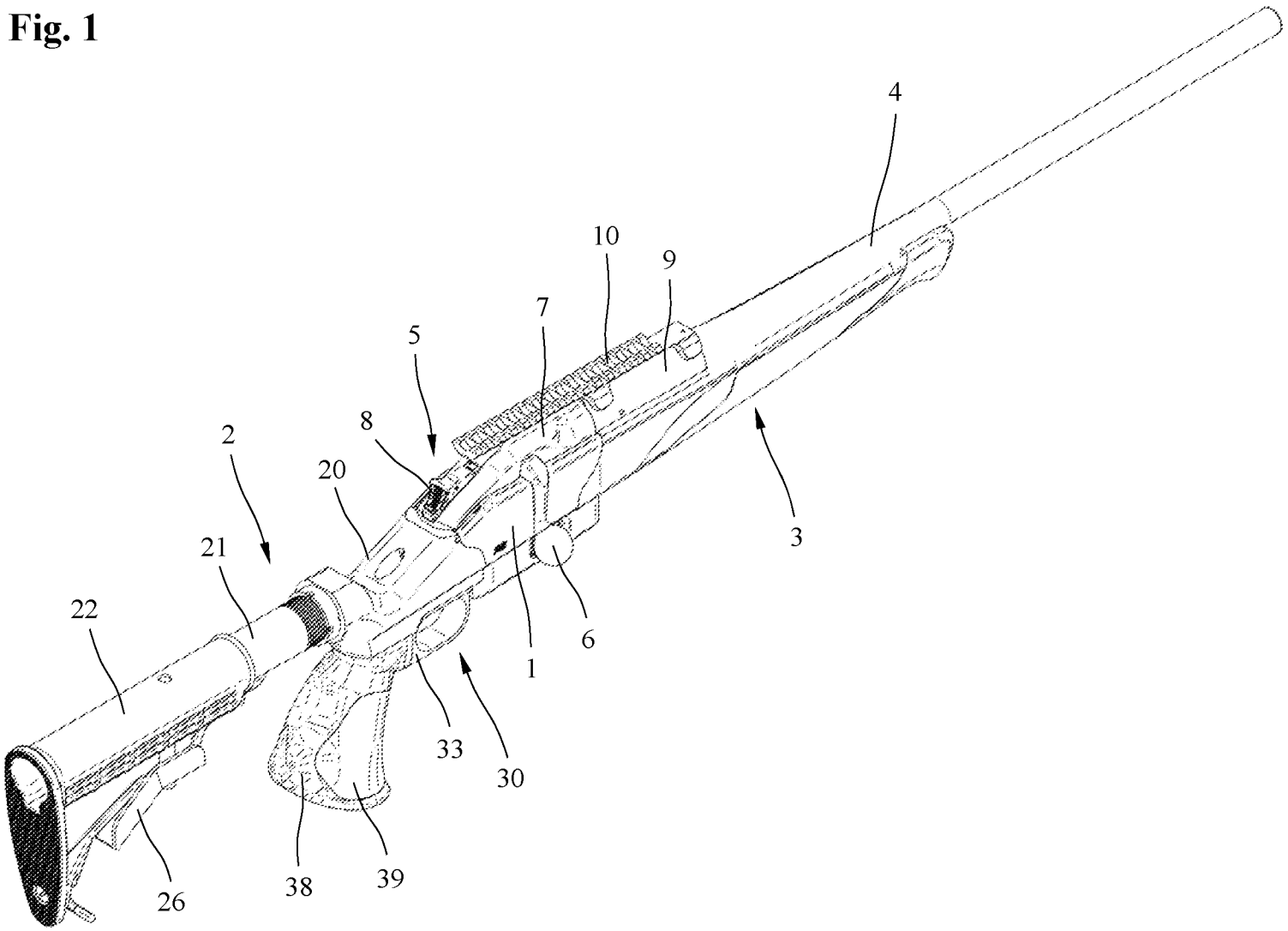
FIG. 1 shows a small arm in a perspective view.

FIG. 1 shows in a perspective view a small arm designed here as a repeating rifle with a slide or receiver 1, a buttstock 2 arranged on the back of the receiver 1, a front shaft 3 arranged on the front of the receiver 1, a barrel 4 fastened on the top of the receiver 1, and a slide 5 arranged to move longitudinally on the receiver 1. A small arm in the depicted embodiment is designed as a straight-pull repeating rifle with a slide 5 designed as a radial slide. The slide 5 contains a slide housing 7 movable by means of a bolt handle 6 between a retracted open position and a front closed position with a slide assembly 8 arranged on the back on the slide housing 7. A mounting device 10 designed here as a Picatinny rail is fastened on an end part 9 of barrel 4 widened in diameter to install a telescopic sight or other attachment.

As follows from FIG. 2, the slide 5 contains the slide head 11 arranged axially movable in slide housing 7 and an expansion sleeve 12 arranged around the slide head 11, through which the slide 5 can be locked in the rear end part 9 of barrel 4 widened in diameter. A firing pin 14, acted upon by means of a firing pin spring 13, is guided to move axially with a firing pin stop 15 in the slide head 11. The firing pin spring 13 can be tightened or released by the slide assembly 8. A trigger mechanism with a sear spring 17 cooperating with the firing pin stop 15 and activatable by means of a pin-like connection element 16 is accommodated in the receiver 1. The structure and function of the trigger mechanism arranged in receiver 1 is described in detail in DE 10 2010 051 641 B3. Explicit reference is made to the disclosure contents with respect to the trigger mechanism accommodated in receiver 1. It is also apparent from FIG. 2 that the receiver 1 contains a magazine guide 18 open at the bottom to accommodate a large-volume magazine 19 protruding downward relative to receiver 1.

Figure 2:
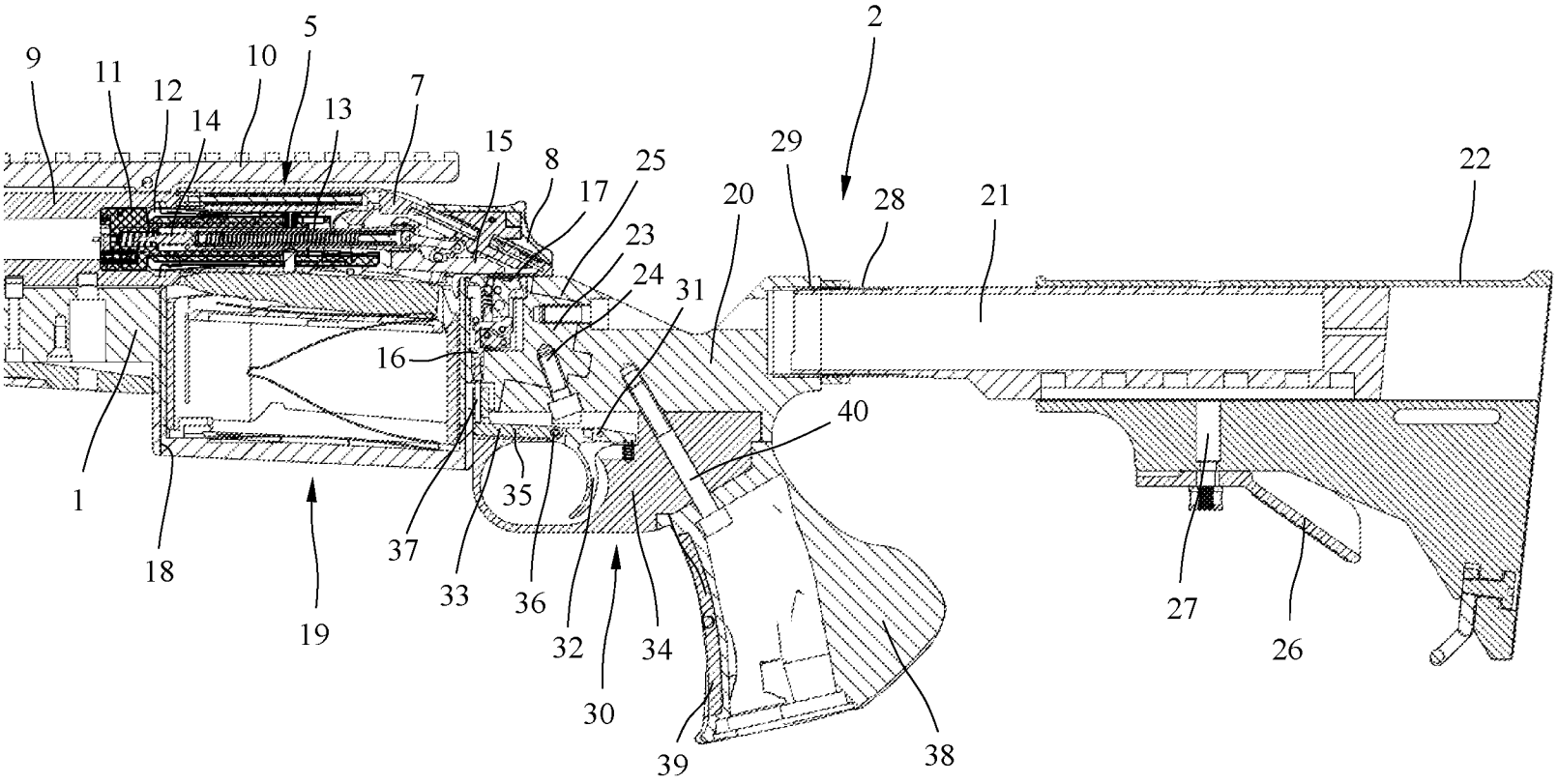
FIG. 2 shows the rear part of the small arm depicted in FIG. 1 in a longitudinal view.
Figure 3:
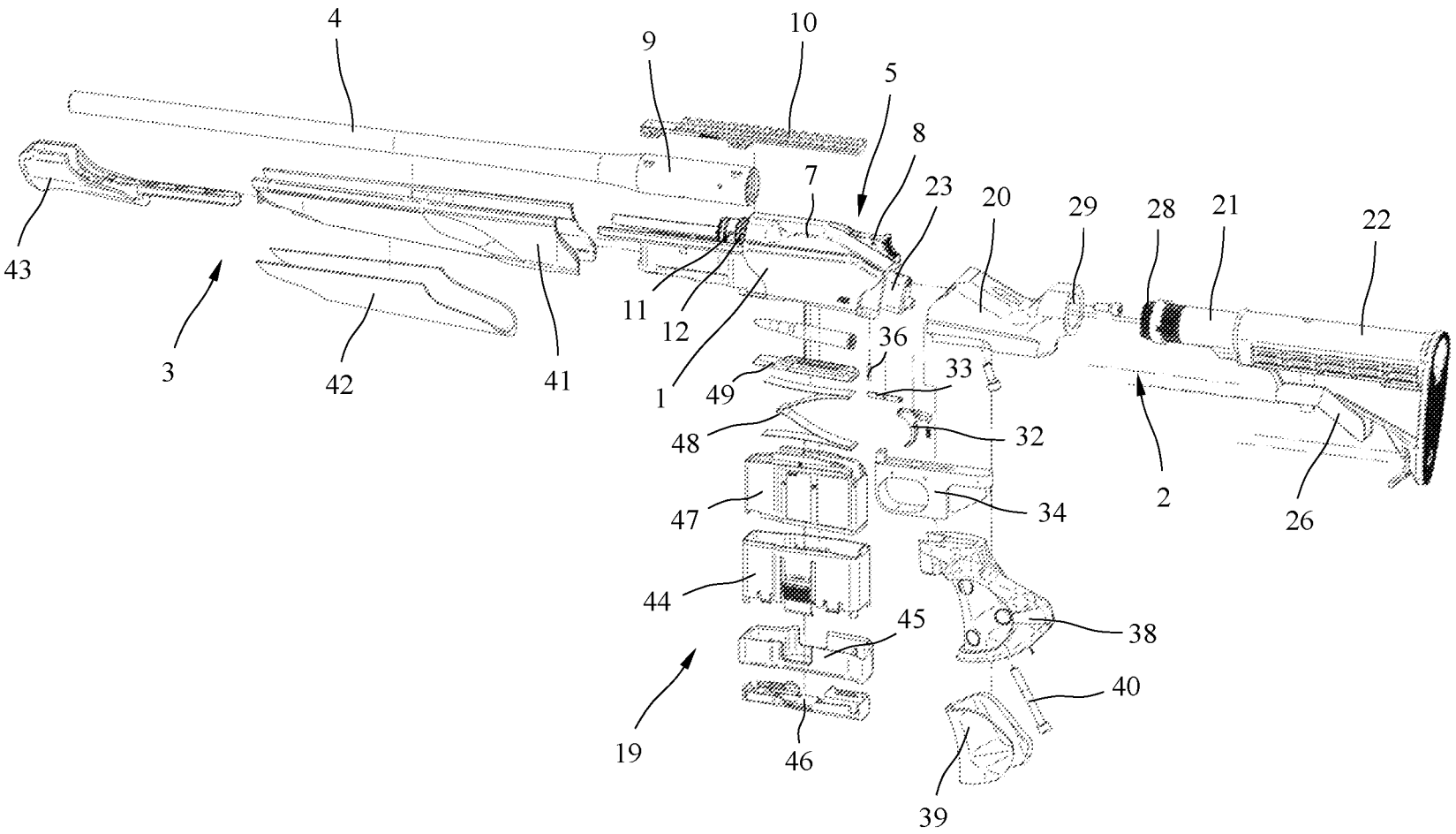
FIG. 3 shows the small arm depicted in FIG. 1 in an exploded view.

It is apparent in FIGS. 2 and 3 that the buttstock 2 includes an extension piece 20 fastened to the back of receiver 1, a tubular guide part 21 fastened on the extension piece 20 and a shoulder support 22 guided to move on the guide part 21. The extension piece 20 is mounted positively connected on a trapezoidal or wedge-like pin 23 formed on the back of receiver 1 and fastened by two screws 24. For this purpose, the extension piece 20 has a contour adapted to the shape of receiver 1, with a front connection area 25 adapted to the shape of pin 23 on its front facing the receiver 1. The connection area 25 is designed here as a recess corresponding to the shape of pin 23 with an inside contour corresponding to the outside contour of pin 23.

As follows from FIG. 3, the trapezoidal or wedge-like pin 23 and, accordingly, also the connection area 25 of extension piece 20 designed as a recess, widen downward, so that the extension piece 20 is supported and secured against lateral displacement. The shoulder support 22 is guided to move axially on the tubular guide part 21 and can be locked in specified withdrawal or insertion positions via a detent mechanism 27 activatable by means of a lever 26. The tubular guide part 21 is screwed into a threaded hole 29 on the rear end of extension piece 20 via threads 28.

A trigger unit 30, depicted in FIG. 2 with a trigger latch 32 pivotable about a transverse axis 31 and a transfer element 33 extending forward when viewed in the firing direction for connection of the trigger latch 32 to the trigger mechanism accommodated in receiver 1, is arranged on the bottom of extension piece 20. The trigger latch 32 and the transfer element 33 are arranged in a trigger housing 34 fastened to the bottom of the extension piece 20. The transfer mechanism 33 designed in the form of a rod or lever is arranged to pivot within the trigger housing 34 about an axis 35 positioned in the center and is connected to the trigger latch 32 via a linkage 36 arranged on the rear end of the transfer element 33 so that the front end of the transfer mechanism 33 is raised by pulling the trigger latch 32. The trigger latch 32 is connected to the pin-like connection element 16 of the trigger mechanism accommodated in receiver 1 via the transfer element 33 and a connection pin 37. The connection pin 37 is guided to move axially in an upwardly protruding attachment of the trigger housing 34.

A grip 38, designed here as a pistol grip, is also fastened on the bottom of extension piece 20 with a replaceable insert 39. The grip 38 arranged behind the trigger latch 32 is screwed together with the trigger housing 34 to the bottom of extension piece 20 via a screw 40.

It is apparent in FIG. 3 that the front shaft 3 consists of a fore end part41 fastened on the front of the receiver 1 with a replaceable insert 42 and a fore end tip 43 fastened to the front of the fore end part 41. The magazine 19 has a magazine housing 44, a magazine stop 45, a magazine bottom 46, and a magazine insert 47 arranged in magazine housing 44 with a cartridge feeder 49 acted upon by means of a magazine spring 48.

Figure 4:
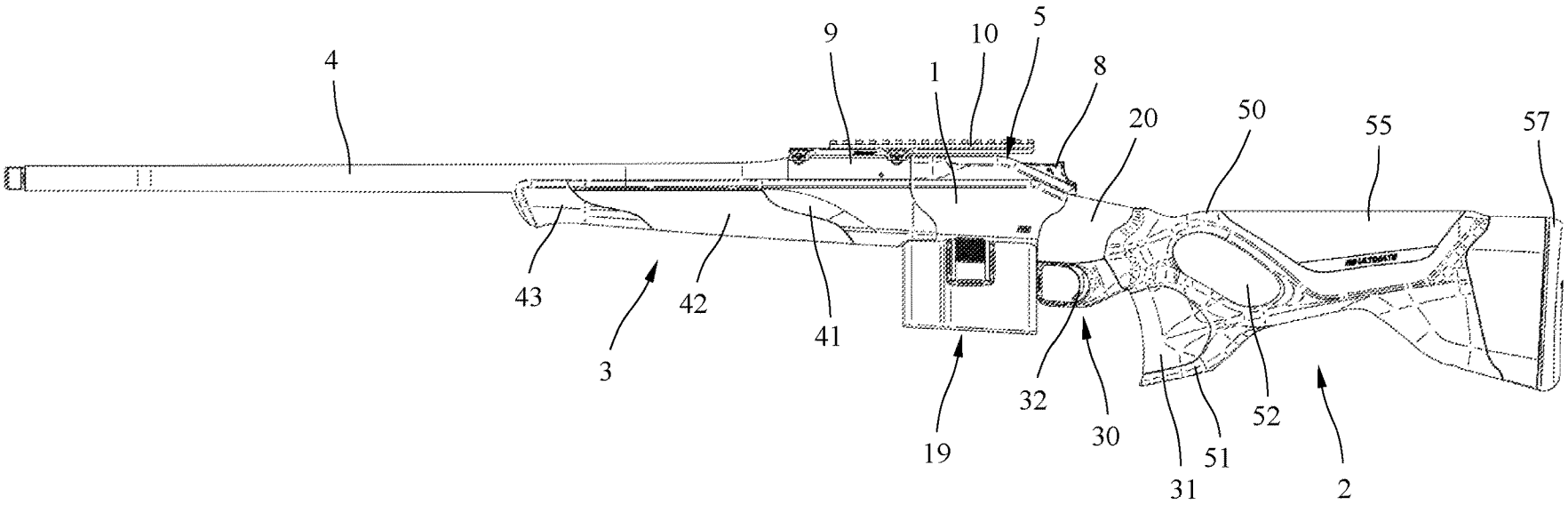
FIG. 4 shows a second embodiment example of a small arm in a side view.
Figure 5:
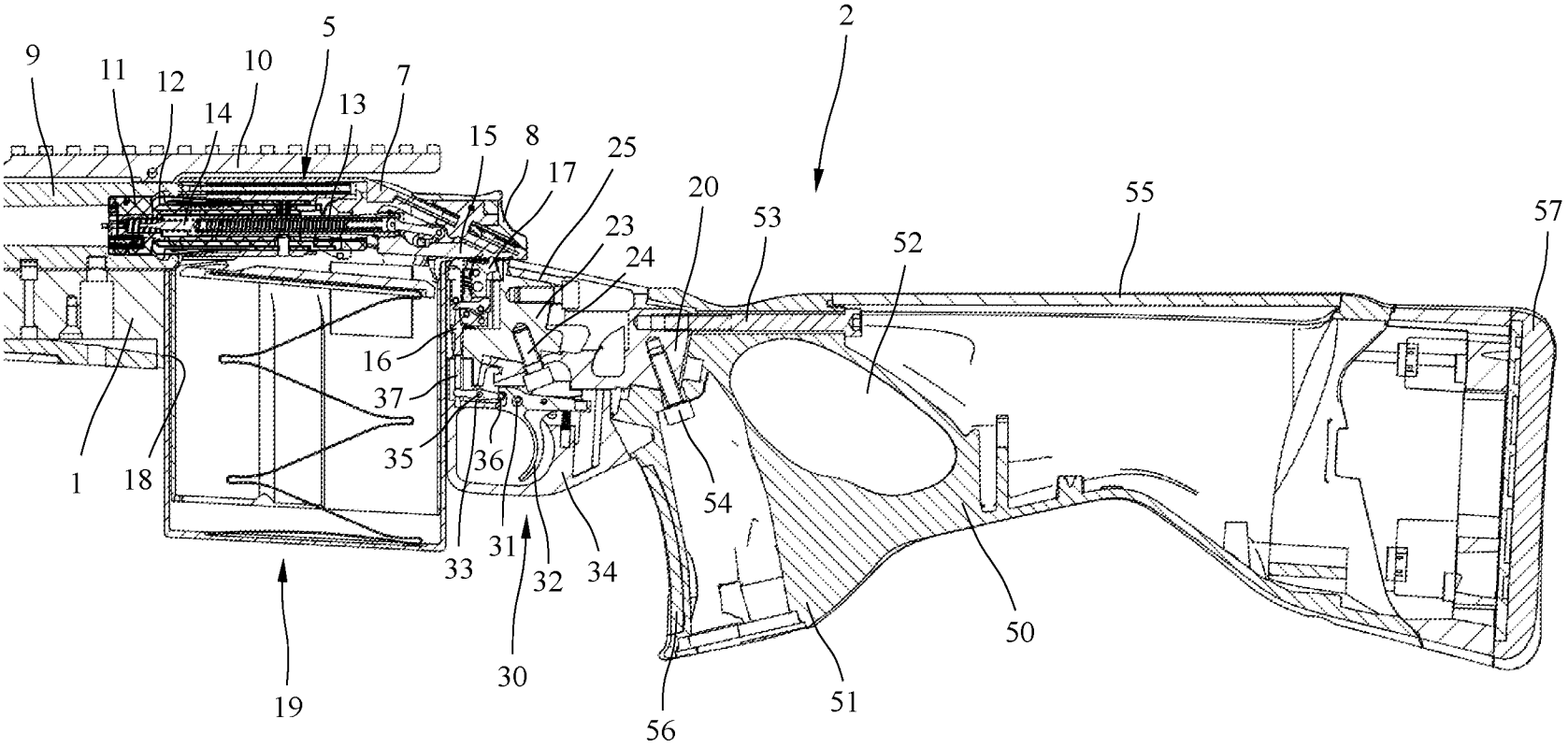
FIG. 5 shows the rear part of the small arm depicted in FIG. 4 in a longitudinal view.

FIGS. 4 and 5 show another embodiment example of a small arm with an alternative buttstock 2. The buttstock 2 in this embodiment also has an extension piece 20 fastenable to receiver 1 and a buttstock part releasably fastenable to extension piece 20. The buttstock part is designed here as a nonadjustable rifle butt 50 with a grip part 51 and a grip hole 52. Inserts 55 and 56 consisting of leather or another material can be arranged on the rifle butt 50 consisting of wood or plastic and fastened via screws 53 and 54 to extension piece 20. On the rear end of rifle butt 50, a shaft end cap 57 is fastened in known fashion. A trigger unit with a trigger latch 32 is also arranged in this embodiment on the extension piece 20 of buttstock 2. Otherwise, the structure of the small arm corresponds to the embodiment just described, so that corresponding components are provided with the same reference numerals and reference is made to their description.

LIST OF REFERENCE NUMBERS

1 Receiver
2 Buttstock
3 Front shaft
4 Barrel
5 Slide
6 Bolt handle
7 Slide housing
8 Slide assembly
9 End part
10 Mounting device
11 Slide head
12 Expansion sleeve
13 Firing pin spring
14 Firing pin
15 Firing pin stop
16 Connection element
17 Sear spring
18 Magazine guide
19 Magazine
20 Extension piece
21 Guide part
22 Shoulder support
23 Pin
24 Screw
25 Connection area
26 Lever
27 Detent mechanism
29 Threads
29 Threaded hole
30 Trigger unit
31 Transverse axis
32 Trigger latch
33 Transfer element
34 Trigger housing
35 Axis
36 Linkage
37 Connection pin
38 Grip
39 Insert
40 Screw
41 Fore end part
42 Insert
43 Fore end tip
44 Magazine housing
45 Magazine stop
46 Magazine bottom
47 Magazine insert
48 Magazine spring
49 Cartridge feeder
50 Rifle butt
51 Grip part
52 Grip hole
53 Screw
54 Screw
55 Insert
56 Insert
57 Shaft end cap

The invention claimed is:

1. A buttstock of a small arm with a front connection area for positive connection to a receiver, wherein a trigger unit with a trigger latch and a transfer element extending forward for connection of the trigger latch to a trigger mechanism arranged in the receiver is positioned on the buttstock; and wherein the transfer element is designed in the form of a rod or lever and is arranged pivotable about an axis and connected via a linkage to the trigger latch so that a front end of the transfer element is raised by pulling the trigger latch.

2. The buttstock according to claim 1, wherein the buttstock includes an extension piece fastenable to the receiver and a rear shaft part releasably fastened to the extension piece.

3. The buttstock according to claim 2, wherein the rear shaft part is designed as a shoulder support or stock adjustable relative to the extension piece.

4. The buttstock according to claim 3, wherein the rear shaft part is designed as a shoulder support and the shoulder support is movably guided on a guide part arranged on the extension piece.

5. The buttstock according to claim 2, wherein the trigger unit with the trigger latch and the transfer element is arranged on the extension piece.

6. The buttstock according to claim 1, wherein the trigger latch and the transfer element are arranged in a trigger housing fastened to the buttstock.

7. The buttstock according to claim 6, wherein the trigger latch is connected to the trigger mechanism arranged in the receiver via the transfer element and a connection pin axially movable in the trigger housing.

8. The buttstock according to claim 1, wherein the front connection area is adapted to a shape of a pin on a back of the receiver and has an internal shape corresponding to an external shape of the pin.

9. The buttstock according to claim 2, wherein a grip is fastened to the extension piece.

10. A small arm with a receiver and the buttstock according to claim 1 arranged on the receiver.

* * * * *